US010344521B2

(12) United States Patent
Ben-Arie

(10) Patent No.: US 10,344,521 B2
(45) Date of Patent: Jul. 9, 2019

(54) SLIDING WINDOW MECHANISM I

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 88 days.

(21) Appl. No.: 15/448,775

(22) Filed: Mar. 3, 2017

(65) Prior Publication Data

US 2017/0254134 A1 Sep. 7, 2017

Related U.S. Application Data

(60) Provisional application No. 62/303,386, filed on Mar. 4, 2016.

(51) Int. Cl.

| | |
|---|---|
| ***E05F 15/681*** | (2015.01) |
| ***E05F 11/48*** | (2006.01) |
| ***E05D 15/16*** | (2006.01) |
| ***E05F 15/41*** | (2015.01) |
| ***E05F 15/686*** | (2015.01) |
| ***E05F 15/684*** | (2015.01) |
| ***E05F 15/665*** | (2015.01) |

(52) U.S. Cl.

CPC ..... *E05F 15/681* (2015.01); *E05D 15/165* (2013.01); *E05F 11/485* (2013.01); *E05F 11/488* (2013.01); *E05F 15/41* (2015.01); *E05F 15/665* (2015.01); *E05F 15/684* (2015.01); *E05F 15/686* (2015.01)

(58) Field of Classification Search

CPC ..... E05F 15/681; E05F 15/684; E05F 15/686
USPC ..... 49/360, 352
See application file for complete search history.

(56) References Cited

U.S. PATENT DOCUMENTS

| | | | | |
|---|---|---|---|---|
| 228,436 | A * | 6/1880 | Bean | 49/360 |
| 1,329,178 | A * | 1/1920 | Hilley | E05F 11/48 292/39 |
| 2,555,710 | A * | 6/1951 | Simpkins | E05F 11/48 16/196 |
| 2,555,859 | A * | 6/1951 | Rappl | E05F 11/488 49/352 |
| 5,249,392 | A * | 10/1993 | Houston | B01J 3/03 49/360 |
| 2016/0047158 | A1* | 2/2016 | Raap | E06B 3/44 49/31 |
| 2017/0009507 | A1* | 1/2017 | Newman | E05F 11/48 |

* cited by examiner

*Primary Examiner* — Marcus Menezes

(57) ABSTRACT

This invention pertains to mechanisms for opening and closing sliding windows especially in homes and buildings. A sliding window comprises a pane which is installed in a sliding frame. The frame is sliding vertically or horizontally within a static outer frame which has two parallel guides that guide the sliding frame. There are three similar approaches for such a mechanism: a two cables mechanism, a single roller chain mechanism and a two roller chains mechanism. The two cable approach uses four pulleys and two flexible cables. The single roller chain approach employs two sprockets. The two roller chains approach uses four sprockets. The window can be operated manually or by using an electric motor. The window assembly includes two safety systems which protect persons from being caught by a closing window. The window assembly also includes a burglar alarm and does not require a latch for window locking.

18 Claims, 12 Drawing Sheets

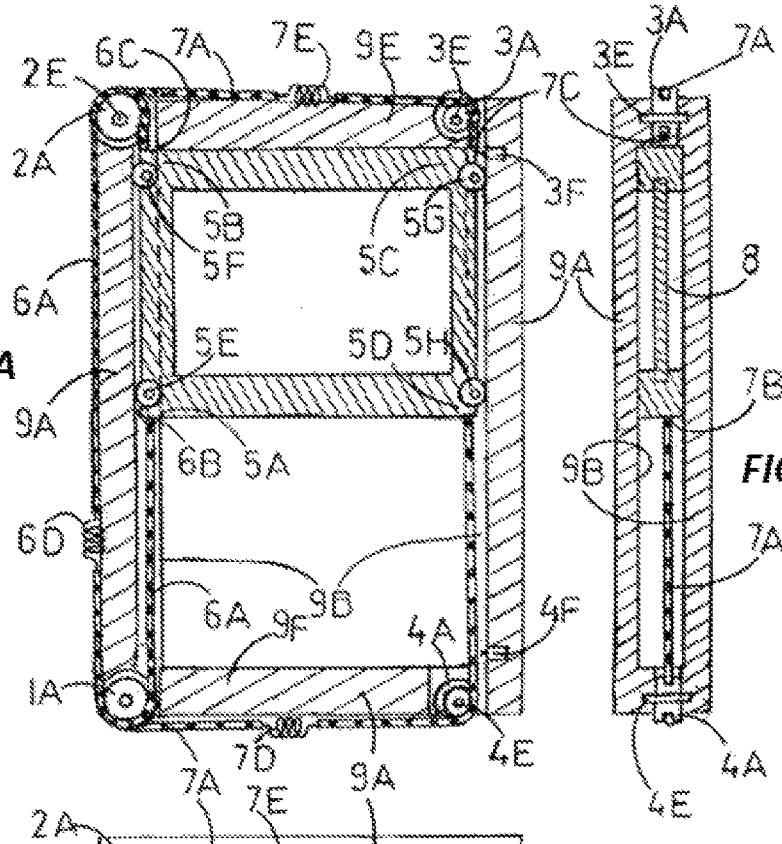
FIG. 2A
FIG. 2B
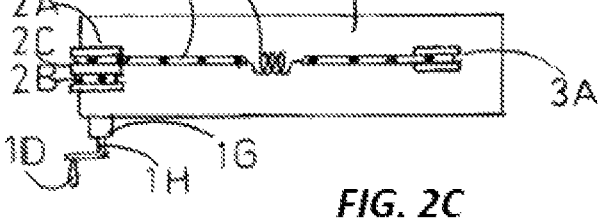
FIG. 2C

SLIDING WINDOW MECHANISM I

CROSS-REFERENCE TO RELATED APPLICATIONS

This Application claims priority from a Provisional Patent Application: Ser. No. 62/303,386 filed on Mar. 4, 2016

FEDERALLY SPONSORED RESEARCH

Not Applicable.

SEQUENCE LISTING OR PROGRAM

Not Applicable.

TECHNICAL FIELD

The present invention relates to sliding window mechanisms.

PRIOR ART

Many mechanisms were invented for sliding windows especially for sliding windows of vehicles. Usually sliding windows have a framed glass pane. The sliding frame slides between two parallel guides which are attached to the walls and are part of the window's static outer frame. When a window is sliding horizontally, the parallel guides are also horizontal. In the case that the windows are sliding vertically, the parallel guides are vertical. Almost all of these sliding window mechanisms for vehicles were designed for horizontal sliding and all of them are using a motorized single cable which is attached to the lower side of the sliding frame in a push-pull or a pull-pull mechanism. In a push-pull mechanism one end of the cable is connected to one of the two lower corners of the sliding frame and moves the sliding frame by pushing it in one horizontal direction or pulling it in opposite direction. This push-pull mechanism requires a thick and stiff cable which does not bend when it pushes the sliding frame. In the pull-pull mechanism the two ends of the cable are connected to the two lower corners of the sliding frame and the window is moved by pulling one corner for one direction or pulling the opposite corner for the opposite direction. This mechanism is more efficient because it requires only pulling which can be implemented with much thinner cable.

We have found many other patents which dealt with mechanisms for sliding windows but none is similar to our invention. These patents are listed here: U.S. Pat. No. 6,125,585 to Koneval et al. (Oct. 3, 2000) teaches a push-pull system for horizontal sliding window for cars. There, the cable is connected only at one lower side of the window. U.S. Pat. No. 6,766,617 to Purcell (Jul. 27, 2004) teaches a horizontal sliding window assembly with pull-pull cable mechanism attached to the lower side of the window. U.S. Pat. No. 5,822,922 to Grumm et al. (Oct. 20, 1998) teaches a horizontal sliding window assembly with push-pull 2-cable mechanism attached to the lower side of two sliding windows. U.S. Pat. No. 6,026,611 Ralston et al. (Feb. 22, 2000) teaches a horizontal sliding window assembly with pull-pull cable mechanism attached to the lower side of the window. U.S. Pat. No. 5,784,833 to Sponable et al. (Jul. 28, 1998) teaches a horizontal sliding window assembly with pull-pull cable mechanism attached to the lower side of the window. US 2014/0352600 to Erskine et al. (Dec. 4, 2014) teaches a windshield sliding window/door assembly which uses a single cable attached to one side of the window. US 2004/0094990 Castellon (May 20, 2004) Teaches a car widow assembly which employs a single motorized cable to move the pane. U.S. Pat. No. 9,233,734 Erskine et al. (Jan. 12, 2016) teaches a windshield sliding window/door assembly which uses a single cable attached to one side of the window. U.S. Pat. No. 6,324,788 Koneval et al. (Dec. 4, 2001) teaches a push-pull system for horizontal sliding window for cars. US 2015/0298528 Lahnala (Oct. 22, 2015) teaches a horizontal sliding window assembly with pull-pull cable mechanism attached to the lower side of the window. US 2007/0277443 Dery et al. (Dec. 6, 2007) teaches a horizontal sliding window assembly with push-pull cable mechanism attached to the lower side of the window. US 2012/0091113 Bennett et al. (Apr. 19, 2012) teaches a horizontal sliding window assembly with pull-pull cable mechanism attached to the lower side of the window. US 2010/0122496 Lahnala (May 20, 2010) teaches a horizontal sliding window assembly with pull-pull cable mechanism attached to the lower side of the window. US 2004/0025439 Purcell (Feb. 2, 2004) teaches a horizontal sliding window assembly with pull-pull cable mechanism attached to the lower side of the window.

None of the Patents and Patent applications described above is similar to our invention.

SUMMARY OF THE INVENTION

Our invention includes mechanisms for opening and closing sliding windows. A sliding window comprises a pane made of transparent material, which is installed in a sliding frame. The frame is sliding within a static outer frame which has two parallel guides that guide the sliding frame. There are three options for such a mechanism: a two cables mechanism, a single roller chain mechanism and a two roller chains mechanism.

Many other mechanisms for sliding windows are based on pulling or pushing only the lower side of the sliding frame. These methods are suitable for horizontal sliding when the upper window's guide has low friction with the sliding frame, and the sliding frame weight is carried by the lower guide. In such cases the cable handles all the friction of the sliding frame with its guides. However, applying force only to one side of the sliding frame is not suitable for vertical sliding windows because the window guides apply approximately equal friction forces to both sides of the frame. If the cable which moves the window is connected only to one side of the sliding frame, it can handle only the friction between the sliding frame and one guide on the cable's side. When one tries to move the window by pulling or pushing only on one side, the friction force of the guide on the opposite side creates a rotation moment force which tends to rotate the sliding frame around its center of symmetry with axis of rotation which is perpendicular to the window's pane plane. This rotation is blocked by the window's guides at two opposite window's corners. Since the window applies pressure on the guides at two opposite corners the window may get stuck in some cases or may not slide smoothly in other cases.

In order to prevent this phenomenon we propose two optional solutions. The simplest solution is to connect the cable's ends to the centers of the upper and lower sides of the sliding frame. This eliminates the rotation moment since the cables are in line with the window's center of symmetry and apply equal force on the left and right sides of the sliding frame. The cable can be moved by rotating one pulley manually or by a motor. This solution requires only one cable in pull-pull mechanism, but it has the disadvantage of a visible cable at the center of the window's pane.

More complex solution uses two cables in a pull-pull mechanism. The ends of one cable are connected to the upper left corner and the lower left corner of the sliding frame. The ends of the second cable are connected to the upper right and lower right corners of the sliding frame. The moment of rotation is eliminated since the cables apply symmetric and equal forces with respect to the window's center of symmetry. The two cables mechanism has the advantage of invisible cables, which can be hidden in the guides. The two cables mechanism requires 4 pulleys installed at the four corners of the window. Two pulleys (on the left side or on the right side) should have two tracks suitable for two cables. The two cables mechanism enables to move both cables by turning one of these two track pulleys, which moves both cables simultaneously. The single cable mechanism uses four single track pulleys and can move the window by turning any one of the four pulleys. Our 1-cable and 2-cable mechanisms are suitable both for vertical or horizontal sliding windows, but are especially useful when both guides apply friction forces on the frame.

Our invention are novel mechanisms for opening and closing sliding windows. The window structure is especially suited for vertical sliding windows in homes and buildings. A sliding window comprises a pane made of transparent material, which has a sliding frame. The sliding frame is configured to slide within a static outer frame. The outer frame has two parallel guides which guide the sliding frame. To facilitate smoother sliding, the sliding frame has four rollers, one at each corner. The rollers roll on the floors of the guides. The rollers are installed at recesses in the sliding frame such that only a small fraction of each roller protrudes from the sliding frame. The parallel guides are vertical for vertically sliding window or horizontal for horizontally sliding window. The mechanisms described here are for a vertical sliding windows, but the same mechanisms can be used for horizontal sliding windows. Our invention includes three close versions of such a mechanism: a two cables mechanism, a two chains mechanism and a single chain mechanism.

The two cables mechanism for a sliding window comprises of a static outer frame which includes two parallel guides, a sliding pane made of transparent material, a sliding frame of the pane, two two-track pulleys and two single track pulleys, an elastic left cable, an elastic right cable, a static pane which is framed at one end of the outer frame and a crank connected to the axis of one of the two track pulleys. More advanced versions of the two cables mechanisms are further comprising: a gearbox, an electrical motor, a control unit, an upper limit switch, a lower limit switch, a safety system, a burglar alarm, a lower spring and an upper spring and a left spring.

The parallel guides which could be vertical or horizontal are guiding the sliding frame. The following paragraphs describe the two cables mechanism for moving a vertical sliding window, but the same two cables mechanism could be used for horizontal sliding window.

The four pulleys in the two cables mechanism are installed at the four corners of the static outer frame. The two 2-track pulleys are installed on one side, say the left hand side i.e. at the outer lower left corner and the outer upper left corner of the outer frame. Correspondingly, these will be denoted by: lower two track pulley and upper two track pulley. The two single track pulleys are installed on the right hand side of the static outer frame i.e. at the outer lower right corner and at the outer upper right corner of the outer frame. Correspondingly, these will be denoted by: lower single track pulley and upper single track pulley. The sliding frame has four corners denoted by: lower left corner, upper left corner, lower right corner and upper right corner.

The lower two track pulley comprises: a first lower track and a second lower track. The upper two track pulley comprises: a first upper track and a second upper track. The left cable has an upper left end and a lower left end. Where lower left end is attached to lower left corner of the sliding frame. The upper left end is attached to the upper left corner. The left cable is strung downwards starting from the lower left corner and is wound around the first lower track. Next, the left cable is strung upwards and is wound around the first upper track. Next, the left cable is strung downwards and ends at the upper left end, which is attached to the upper left corner.

The right cable has an upper right end and a lower right end. Where the lower right end is attached to the lower right corner and the upper right end is attached to the upper right corner. The right cable is strung downwards starting from the lower right end and is wound around the lower single track pulley. Next, the right cable is strung leftwards and is wound around the second lower track. Next, the right cable is strung upwards and is wound around the second upper track. Next, the right cable is strung rightwards and is wound around the upper single track pulley. Next, the right cable is strung downwards and ends at upper right end, which is attached to the upper right corner.

Incrementally, turning clockwise the lower two track pulley moves the left and the right cables the same increment of distance upwards on the left hand side of the lower two track pulley. This results in pulling down the lower left corner by the left cable and pulling down the lower right corner by the right cable. Thus, the left and right corners are pulled down by the same increment of distance. At the same time, the left cable releases the upper left corner of the sliding frame and the right cable releases the upper right corner of the sliding frame also by the same increment of distance. As a consequence, the whole sliding frame is moved down by the same increment of distance. Hence, the sliding frame can be moved downwards by turning the lower two track pulley in clockwise direction. To facilitate turning the lower two track pulley, a crank is connected to the axis of the lower two track pulley.

Similarly, incremental turning of the lower two track pulley in counterclockwise direction, moves the left and the right cables the same increment of distance downwards on the left hand side of the lower two track pulley. This results in pulling up the upper left corner by the left cable and pulling up the upper right corner by the right cable. Thus, the upper left and upper right corners are pulled up by the same increment of distance. At the same time, the left cable releases upwards the lower left corner of the sliding frame and the right cable releases upwards the lower right corner of the sliding frame also by the same increment of distance. As a consequence, the whole sliding frame is moved upwards by the same increment of distance. Hence, the sliding frame can be moved upwards by turning the lower two track pulley in counterclockwise direction.

The lower two track pulley is used for moving the left and the right cables. To provide more friction between the left and the right cables and the lower two track pulley, the left cable could be wound more than one turn around the first lower track and the right cable could be wound more than once around the second lower track of the lower two track pulley. The two cables mechanism also includes a lower spring and an upper spring and a left spring. The upper and lower springs are installed in tandem with the right cable, while the left spring is installed in tandem with the left cable. These springs are preloaded and have biases which preserve the tension levels of the left and the right cables.

The two cables mechanism also includes an optional gearbox which includes an input gearbox axis, an output gearbox axis and a gearbox. The crank is connected to the input gearbox axis and the output gearbox axis is connected to the lower two track pulley. The crank is configured to manually turn the input gearbox axis, where the output gearbox axis is configured to turn the lower two track pulley. The gearbox is configured to convert the turning speed of the input gearbox axis into a lower turning speed of the output gearbox axis by a predetermined ratio. Reducing the speed ratio between the input axis and the output axis amplifies the manual turning moment of the crank and conveys more power to the lower two track pulley.

The two cables mechanism provides the option to replace the crank by an electrical motor, which is mechanically connected to the input gear axis. The electrical motor is electrically connected to a control unit which controls the direction and the speed of the electrical motor. The electrical motor is configured to turn the lower two track pulley in clockwise direction or in counterclockwise direction. Hence, the sliding window can be moved down or up respectively by the electrical motor. The control unit also includes a control box by which a user can control the direction and the speed of the electrical motor.

The two cables mechanism also includes a lower limit switch and an upper limit switch, which are installed at the outer frame. The lower limit switch is activated when the sliding frame reaches its lowest position within the outer frame. The upper limit switch is activated when the sliding frame reaches its highest position within the outer frame. The lower limit switch and the upper limit switch are connected to the control unit and are configured to stop the electrical motor when they are activated. By this method the motion of the sliding frame is controlled not to impact the outer frame.

Another use of the lower limit switch is to activate the burglar alarm when the switch changes from activated state into deactivated state. This could happen when the window is closed and it being raised by a burglar. However the two cables mechanism provides extra protection from burglary since when the window is closed it is extremely hard to open them since moving the window requires to rotate the gear in reverse direction. Hence, a sliding window with the two cables mechanism does not need a latch.

The two cables mechanism is also equipped with a safety system which protects persons from being caught by a closing window. The safety system comprises of a safety switch and a safety bar. Where the safety switch is connected to the control unit. The safety switch is installed on top of the lower outer horizontal bar and the safety bar is installed on top of the safety switch. When a person leans out of the window the person is pressing on the safety bar, which activates the safety switch which in turn instructs the control unit to reverse the motor's direction i.e. to open the window.

The two cables mechanism also introduces an additional safety feature, which also protects persons and objects against being caught by the window. The control unit which controls the motor is equipped with an electrical overload sensor which can detect a sudden overload of the motor's current. Such an overload happens when the window is in the process of closing and it hits an obstruction. Thus, when the load circuit detects an obstruction it instructs the control unit to reverse the motor which opens the window.

The Two chains mechanism: Our invention are novel mechanisms for opening and closing sliding windows. The window structure is especially suited for vertical sliding windows in homes and buildings. A sliding window comprises a pane made of transparent material, which has a sliding frame. The sliding frame is configured to slide within a static outer frame. The outer frame has two parallel guides which guide the sliding frame. To facilitate smoother sliding, the sliding frame has four rollers, one at each corner. The rollers roll on the floors of the guides. The rollers are installed at recesses in the sliding frame such that only a small fraction of each roller protrudes from the sliding frame. The parallel guides are vertical for vertically sliding window or horizontal for horizontally sliding window. The mechanisms described here are for a vertical sliding windows, but the same mechanisms can be used for horizontal sliding windows. Our invention includes three close versions of such a mechanism: a two cables mechanism, a two chains mechanism and a single chain mechanism.

The two chains mechanism for a sliding window comprises of a static outer frame which includes two parallel guides, a sliding pane made of transparent material, a sliding frame of the pane, two two-track sprokets and two single track sprokets, a left roller chain, a right roller chain, a static pane which is framed at one end of the outer frame and a crank connected to the axis of one of the two track sprokets. More advanced versions of the two roller chain mechanisms are further comprising: a gearbox, an electrical motor, a control unit, an upper limit switch, a lower limit switch, a safety system, a burglar alarm.

The parallel guides which could be vertical or horizontal are guiding the sliding frame. The following paragraphs describe the two roller chain mechanism for moving a vertical sliding window, but the same two roller chain mechanism could be used for horizontal sliding window.

The four pulleys in the two roller chain mechanism are installed at the four corners of the static outer frame. The two 2-track pulleys are installed on one side, say, the left hand side i.e. at the outer lower left corner and the outer upper left corner of the outer frame. Correspondingly, these will be denoted by: lower two track pulley and upper two track pulley. The two single track pulleys are installed on the right hand side of the static outer frame i.e. at the outer lower right corner and at the outer upper right corner of the outer frame. Correspondingly, these will be denoted by: lower single track pulley and upper single track pulley. The sliding frame has four corners denoted by: lower left corner, upper left corner, lower right corner and upper right corner.

The lower two track pulley comprises: a first lower track and a second lower track. The upper two track pulley comprises: a first upper track and a second upper track. The left roller chain has an upper left end and a lower left end. Where lower left end is attached to lower left corner of the sliding frame. The upper left end is attached to the upper left corner of the sliding frame. The left roller chain is strung downwards starting from the lower left corner and is wound around the first lower track. Next, the left roller chain is strung upwards and is wound around the first upper track. Next, the left roller chain is strung downwards and ends at the upper left end, which is attached to the upper left corner.

The right roller chain has an upper right end and a lower right end. Where the lower right end is attached to the lower right corner and the upper right end is attached to the upper right corner. The right roller chain is strung downwards starting from the lower right end and is wound around the lower single track sprocket. Next, the right roller chain is strung leftwards and is wound around the second lower track. Next, the right roller chain is strung upwards and is wound around the second upper track. Next, the right roller chain is strung rightwards and is wound around the upper single track sprocket. Next, the right roller chain is strung downwards and ends at upper right end, which is attached to the upper right corner.

Incrementally, turning clockwise the lower two track sprocket moves the left and the right roller chains the same increment of distance upwards on the left hand side of the lower two track sprocket. This results in pulling down the lower left corner by the left roller chain and pulling down the lower right corner by the right roller chain. Thus, the left and right corners are pulled down by the same increment of distance. At the same time, the left roller chain releases the upper left corner of the sliding frame and the right roller chain releases the upper right corner of the sliding frame also by the same increment of distance. As a consequence, the whole sliding frame is moved down by the same increment of distance. Hence, the sliding frame can be moved downwards by turning the lower two track sprocket in clockwise direction. To facilitate turning the lower two track sprocket, a crank is connected to the axis of the lower two track sprocket.

Similarly, incremental turning of the lower two track sprocket in counterclockwise direction, moves the left and the right roller chains the same increment of distance downwards on the left hand side of the lower two track sprocket. This results in pulling up the upper left corner by the left roller chain and pulling up the upper right corner by the right roller chain. Thus, the upper left and upper right corners are pulled up by the same increment of distance. At the same time, the left roller chain releases upwards the lower left corner of the sliding frame and the right roller chain releases upwards the lower right corner of the sliding frame also by the same increment of distance. As a consequence, the whole sliding frame is moved upwards by the same increment of distance. Hence, the sliding frame can be moved upwards by turning the lower two track sprocket in counterclockwise direction.

The two chains mechanism also includes an optional gearbox which includes an input gearbox axis, an output gearbox axis and a gearbox. The crank is connected to the input gearbox axis and the output gearbox axis is connected to the lower two track sprocket. The crank is configured to manually turn the input gearbox axis, where the output gearbox axis is configured to turn the lower two track sprocket. The gearbox is configured to convert the turning speed of the input gearbox axis into a lower turning speed of the output gearbox axis by a predetermined ratio. Reducing the speed ratio between the input axis and the output axis amplifies the manual turning moment of the crank and conveys more power to the lower two track sprocket.

The two chains mechanism provides the option to replace the crank by an electrical motor, which is mechanically connected to the input gear axis. The electrical motor is electrically connected to a control unit which controls the direction and the speed of the electrical motor. The electrical motor is configured to turn the lower two track sprocket in clockwise direction or in counterclockwise direction. Hence, the sliding window can be moved down or up respectively by the electrical motor. The control unit also includes a control box by which a user can control the direction and the speed of the electrical motor.

The two roller chain mechanism also includes a lower limit switch and an upper limit switch, which are installed at the outer frame. The lower limit switch is activated when the sliding frame reaches its lowest position within the outer frame. The upper limit switch is activated when the sliding frame reaches its highest position within the outer frame. The lower limit switch and the upper limit switch are connected to the control unit and are configured to stop the electrical motor when they are activated. By this method the motion of the sliding frame is controlled not to impact the outer frame.

Another use of the lower limit switch is to activate the burglar alarm when the switch changes from activated state into deactivated state. This could happen when the window is closed and it being raised by a burglar. However the two roller chain mechanism provides extra protection from burglary since when the window is closed it is extremely hard to open them since moving the window requires to rotate the gear in reverse direction. Hence, a sliding window with the two roller chain mechanism does not need a latch.

The two roller chain mechanism is also equipped with a safety system which protects persons from being caught by a closing window. The safety system comprises of a safety switch and a safety bar. Where the safety switch is connected to the control unit. The safety switch is installed on top of the lower outer horizontal bar and the safety bar is installed on top of the safety switch.

When a person leans out of the window the person is pressing on the safety bar, which activates the safety switch (which is connected to the control unit) which in turn instructs the control unit to reverse the motor's direction i.e. to open the window.

The two roller chain mechanism also introduces an additional safety feature, which also protects persons and objects against being caught by the window. The control unit which controls the motor is equipped with an electrical overload sensor which can detect a sudden overload of the motor's current. Such an overload happens when the window is in the process of closing and it hits an obstruction. Thus, when the load circuit detects an obstruction it instructs the control unit to reverse the motor which opens the window.

The single roller chain mechanism for a sliding window comprises: a static outer frame which includes two parallel guides, a sliding pane made of transparent material, a sliding frame of the pane, two single track sprockets, a roller chain, a static pane which is framed at one end of the outer frame and a crank connected to the axis of one of the single track sprockets. The parallel guides which could be vertical or horizontal are guiding the sliding frame. The following paragraphs describe the single roller chain mechanism for moving a vertical sliding window, but the same single roller chain mechanism could be used for horizontal sliding window.

The two single track sprockets in the single roller chain mechanism are installed at two locations of the static outer frame. Two sprockets are installed on the left hand side i.e. at the outer lower left corner and the outer upper left corner of the outer frame. Correspondingly, these will be denoted by: lower left sprocket and upper left sprocket. The sliding frame has four corners named: lower left corner, upper left corner, lower right corner and upper right corner.

The roller chain has an upper end and a lower end. Where the lower end is attached to the lower left corner and the upper end is attached to the upper left corner. The roller chain is strung downwards starting from the lower end and is wound around the lower left sprocket. Next, the roller chain is strung upwards and is wound around the upper left sprocket. Next, the roller chain is strung downwards and ends at upper end, which is attached to the upper left corner.

Incrementally, turning clockwise the lower two track sprocket moves the roller chain an increment of distance upwards on the left side of the lower two track sprocket. This results in pulling down the lower left corner by the roller chain. At the same time, the roller chain releases the upper left corner of the sliding frame also by the same increment of distance. As a consequence, the whole sliding frame is moved down by the same increment of distance. Hence, the sliding frame can be moved downwards by turning the lower left sprocket in clockwise direction. To facilitate turning the lower two track sprocket, the crank is connected to the axis of the lower left sprocket.

Similarly, incrementally turning counterclockwise the lower left sprocket moves the roller chain an increment of distance downwards on the left side of the lower left sprocket. This results in pulling upwards the upper left by the roller chain. At the same time, the roller chain releases the lower left of the sliding frame also by the same increment of distance. As a consequence, the whole sliding frame is moved up by the same increment of distance. Hence, the sliding frame can be moved upwards by turning the lower left sprocket in counterclockwise direction.

The single roller chain mechanism also includes an optional gearbox comprising an input gearbox axis, an output gearbox axis and a gearbox. The crank is connected to the input gearbox axis and the output gearbox axis is connected to the lower left sprocket. The crank is configured to manually turn the input gearbox axis, where the output gearbox axis is configured to turn the lower left sprocket. The gearbox is configured to convert the turning speed of the input gearbox axis into a lower turning speed of the output gearbox axis by a predetermined ratio. Reducing the speed ratio between the input axis and the output axis amplifies the manual turning moment of the crank and conveys more power to the lower left sprocket.

The single roller chain mechanism provides the option to replace the crank by an electrical motor, which is mechanically connected to the input gear axis. The electrical motor is electrically connected to a control unit which controls the direction and the speed of the electrical motor. The electrical motor is configured to turn the lower left sprocket in clockwise direction or in counterclockwise direction. Hence, the sliding window is configured to be moved down or up respectively by the electrical motor. The control unit also includes a control box by which a user can control the direction and the speed of the electrical motor.

The single roller chain mechanism also includes a lower limit switch and an upper limit switch, which are installed in the outer frame. The lower limit switch is activated when the sliding frame reaches its lowest position within the outer frame. The upper limit switch is activated when the sliding frame reaches its highest position within the outer frame. The lower limit switch and the upper limit switch are connected to the control unit and are configured to stop the electrical motor when they are activated. By this method the motion of the sliding frame is controlled not to impact the outer frame.

The single roller chain mechanism is also equipped with a safety system which protects persons from being caught by a closing window. The safety system comprises of a safety switch and a safety bar. Where the safety switch is connected to the control unit. The safety switch is installed on top of the lower outer horizontal bar and the safety bar is installed on top of the safety switch.

When a person leans out of the window the person is pressing on the safety bar, which activates the safety switch which in turn instructs the control unit to reverse the motor's direction i.e. to open the window.

The single roller chain mechanism also introduces an additional safety feature, which also protects persons and objects against being caught by the window. The control unit which controls the motor is equipped with an electrical overload sensor which can detect a sudden overload of the motor's current. Such an overload happens when the window is in the process of closing and it hits an obstruction. Thus, when the load circuit detects an obstruction it instructs the control unit to reverse the motor which opens the window.

BRIEF DESCRIPTION OF THE DRAWINGS

FIGS. 2A, 2B, 2C illustrate the frontal, side and top views respectively of the two cables mechanism. The frontal and the side views are cross sections.

DETAILED DESCRIPTION OF THE DRAWINGS

Figure 1:
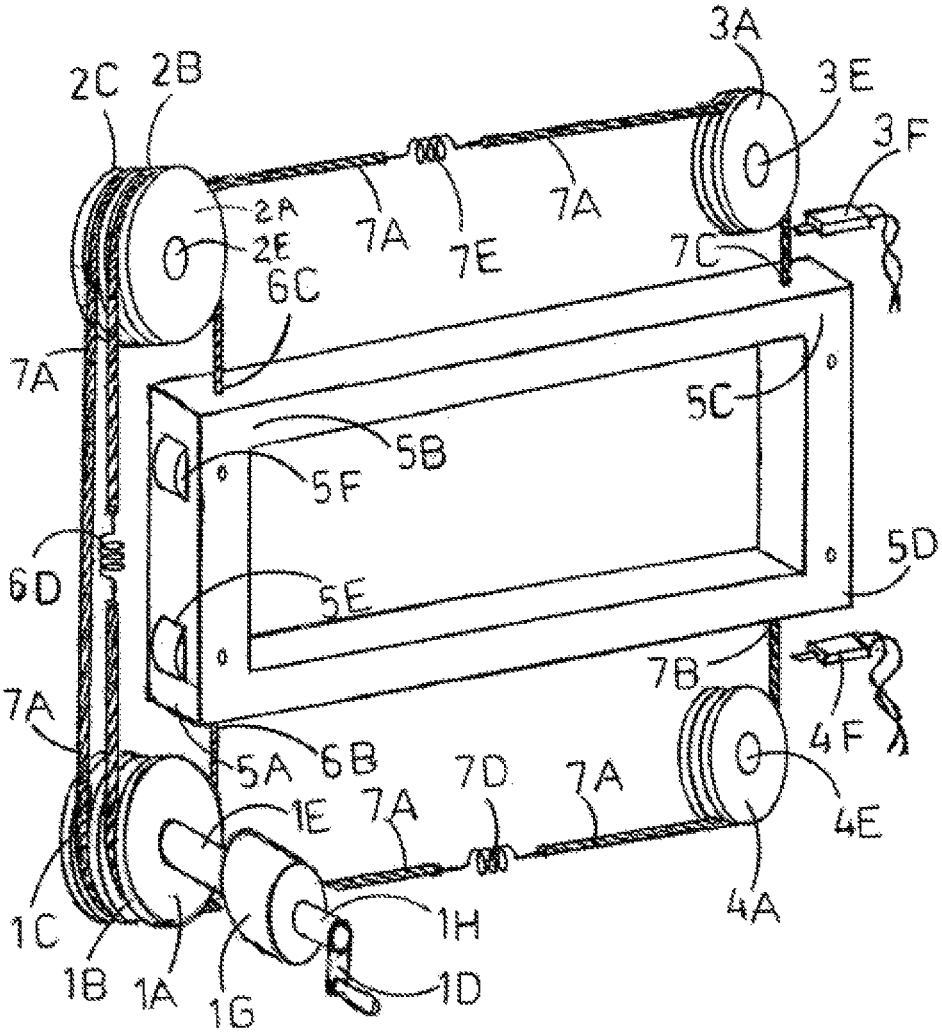
FIG. 1 describes in a blow-up isometric drawing the moving parts of the two cables mechanism. This includes the four sprockets, the left and right cables, a crank, a gearbox and the sliding frame. The lower left pulley also has a crank for manual operation.

FIG. 1 describes in isometric drawing the moving parts of the two cables mechanism. This includes the four pulleys: 1A, 2A, 3A and 4A, the left cable: 6A-6B-6C and the right cable 7A-7B-7C and the sliding frame four corners: 5A-5B-5C-5D. Pulley 1A is the lower two track pulley installed at the lower left outer corner of the outer frame. Pulley 2A is the upper two track pulley installed at the upper left outer corner of the outer frame. Pulley 4A is the lower single track pulley installed at the lower right outer corner of the outer frame. Pulley 3A is the upper single track pulley installed at the upper right outer corner of the outer frame. The left cable has an upper left end 6C and a lower left end 6B. Where the lower left end 6B is attached to the lower left corner 5A of the sliding frame. The upper left end 6C is attached to the upper left corner 5B. The left cable 6A is strung downwards starting from the lower left corner 5A and is wound around the first lower track 1B of the lower two track pulley 1A. Next the left cable is strung upwards and is wound around the first upper track 2B of the upper two track pulley 2A. Next, the left cable is strung downwards and ends at the upper left end 6C, which is attached to the upper left corner 5B.

The right cable comprising an upper right end 7C and a lower right end 7B. Where the lower right end 7B is attached to the lower right corner 5D. The upper right end 7C is attached to the upper right corner 5C. The right cable 7A is strung downwards starting from the lower right end 7B and is wound around the lower single track pulley 4A. Next, the right cable 7A is strung leftwards and is wound around the second lower track 1C of the lower two track pulley 1A. Next, the right cable is strung upwards and is wound around the second upper track 2C of the upper two track pulley 2A. Next, the right cable 7A is strung rightwards and is wound around the upper single track pulley 3A. Next, the right cable is strung downwards and ends at upper right end 7C, which is attached to the upper right corner 5C of the sliding frame.

The lower two track pulley 1A also has a crank 1D for manual operation. The crank 1D is installed on the input gearbox axis 1H of the gearbox 1G which is connected by the output gearbox axis 1E to the lower two track pulley 1A. When the pulley 1A is turned incrementally in clockwise direction, the left hand side of the cables 6A (left cable) and 7A (right cable) are moved upwards by the same distance increment: dx. As a result the lower ends of the cables 6A and 7A which are denoted by 6B and 7B correspondingly (lower left end and lower right end) move downwards by dx and pull downwards also by dx the corresponding sliding frame corners 5A (denoted by: lower left corner) and 5D (denoted by: lower right corner). At the same time, the corresponding upper cable ends 6C and 7C also move downwards by dx and allow their correspondingly attached sliding frame corners 5B (upper left corner) and 5C (upper right corner) to move downwards by the same distance increment dx. As a consequence, the whole sliding frame is moved downwards by dx. Thus, by turning the lower two track pulley 1A in clockwise direction the sliding frame can be moved downwards as much as needed within the range of the outer frame.

On the other hand, when the lower two track pulley 1A is turned incrementally in counterclockwise direction, the left hand sides of the left and right cables 6A and 7A are moved downwards by the same distance increment: dy. As a result the lower ends of the left and right cables 6A and 7A which are denoted by 6B and 7B correspondingly, move upwards by dy and allow the corresponding sliding frame lower left and lower right corners 5A and 5D to move upwards by dy. At the same time, the corresponding upper left and right cable ends 6C and 7C also move upwards by dy and pull upwards their correspondingly attached sliding frame upper left and upper right corners 5B and 5C by the same distance increment dy. As a consequence, the sliding frame is moved upwards by dy. Thus, by turning the lower two track pulley 1A in counterclockwise direction the sliding frame can be moved upwards as much as needed within the outer frame's range.

Additional features displayed in FIG. 1 are the two tracks of the lower two track pulley 1A i.e. the first lower track 1B and the second lower track 1C. Similarly the two tracks of the upper two track pulley 2A are the first upper track 2B and the second upper track 2C. The two cables mechanism is equipped also with an upper limit switch 3F and a lower limit switch 4F and with a lower spring 7D and an upper spring 7E for preserving the tension levels of the right cable and the left spring 6D for preserving the tension level of the left cable.

Figure 4:
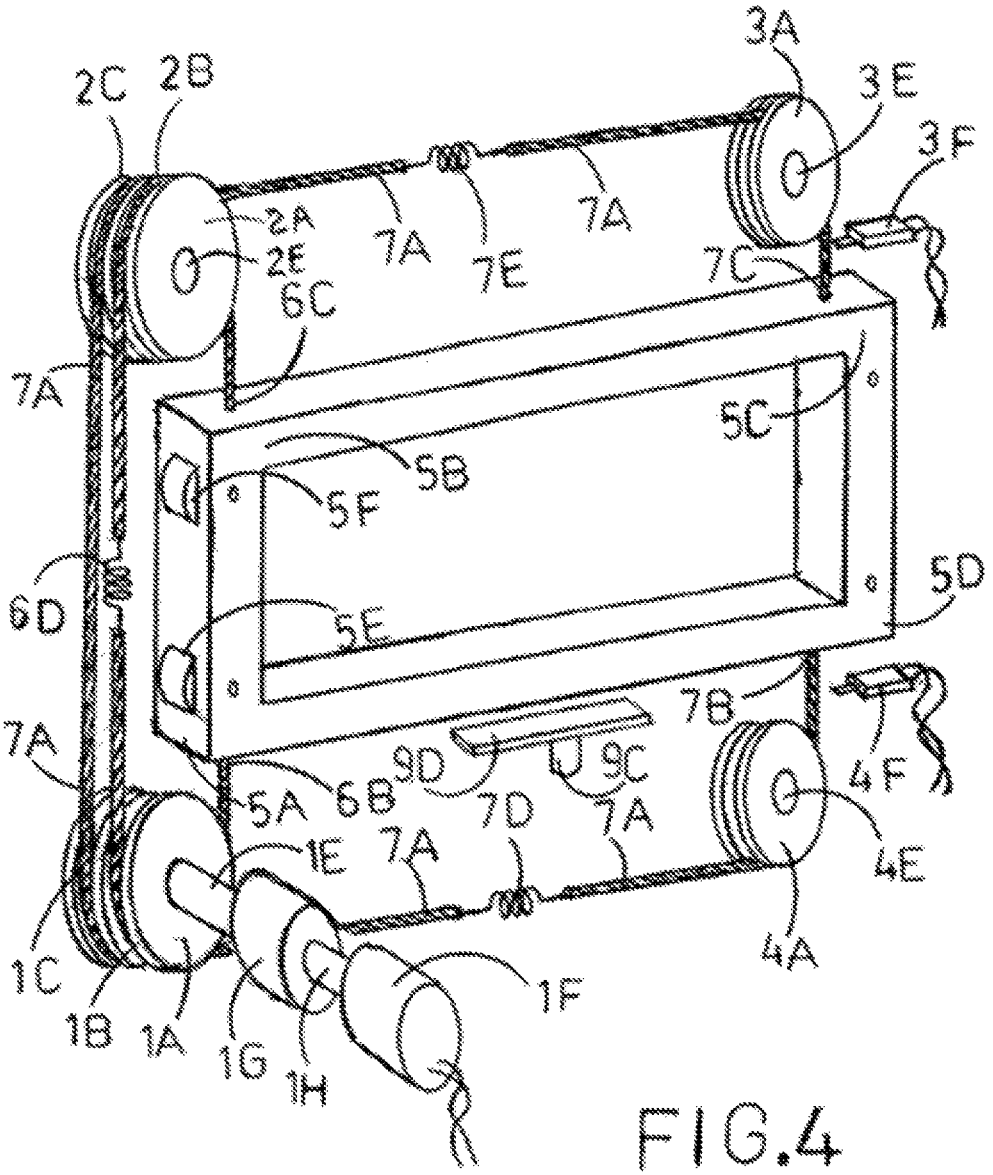
FIG. 4 is identical to FIG. 1 except for the replacement of the crank with an electrical motor which enables motorized opening and closing.
Figures 5A, 5B, 5C:
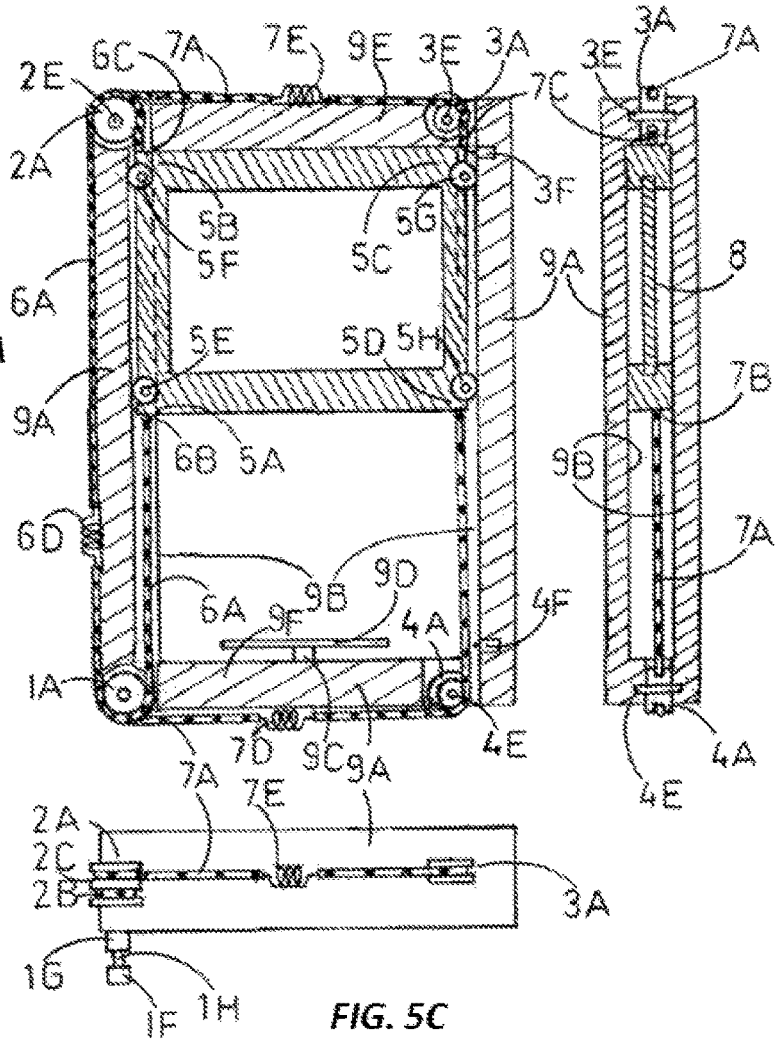
FIGS. 5A, 5B, 5C are identical to FIGS. 2A, 2B, 2C except for the replacement of the crank with an electrical motor which enables motorized opening and closing.

FIGS. 2A, 2B, 2C show 3 views of the sliding window two cables mechanism. FIGS. 5A, 5B, 5C are identical to FIGS. 2A, 2B, 2C except for the replacement of the crank 1D with the electrical motor 1F. The frontal and the side views are in cross sections. As can be observed in FIG. 2A, the pane 8 is framed by the sliding frame which has four corners: 5A, 5B, 5C, 5D. The sliding frame is guided by two parallel, vertical guides 9B which are at the inner side of the vertical bars of the outer frame 9A. The rollers 5E, 5F, 5G, 5H are installed at recesses near the corresponding sliding frame corners: 5A, 5B, 5C, 5D. The two track pulleys 1A and 2A are installed at the lower left corner and the upper left corner of the outer frame 9A. The single track pulleys 4A and 3A are installed at the lower right corner and the upper right corner of the outer frame 9A. As seen in FIG. 1, the left and right cables 6A and 7A are wound around the corresponding first lower track 1B and in second lower track 1C of the lower two track sprocket 1A. The left cable 6A and the right cable 7A could be wound more than once in order to increase the friction between the cables and the sprocket 1A. Next, cables 6A and 7A are strung upwards and wound around the corresponding first upper track 2B and second upper track 2C of upper two track pulley 2A. The single track pulleys: upper single track pulley 3A and lower single track pulley 4A are installed at the corresponding upper right and the lower right corners of the outer frame 9A. The four pulleys 1A, 2A, 3A and 4A rotate around the axles 1E, 2E, 3E and 4E correspondingly which are installed in the outer frame 9A. Pulley 1A has a crank 1D which is installed on the input gearbox axis 1H. The gearbox has an output gearbox axis 1E (shown in FIG. 1) which is connected to the axis 1E and enables manual turning of the lower two track pulley 1A which drives the whole sliding window mechanism. As illustrated in FIGS. 4 and 5, the crank 1D is replaced by an electrical motor 1F to provide motorized opening and closing of the two cable sliding window mechanism.

Figures 3A, 3B, 3C:
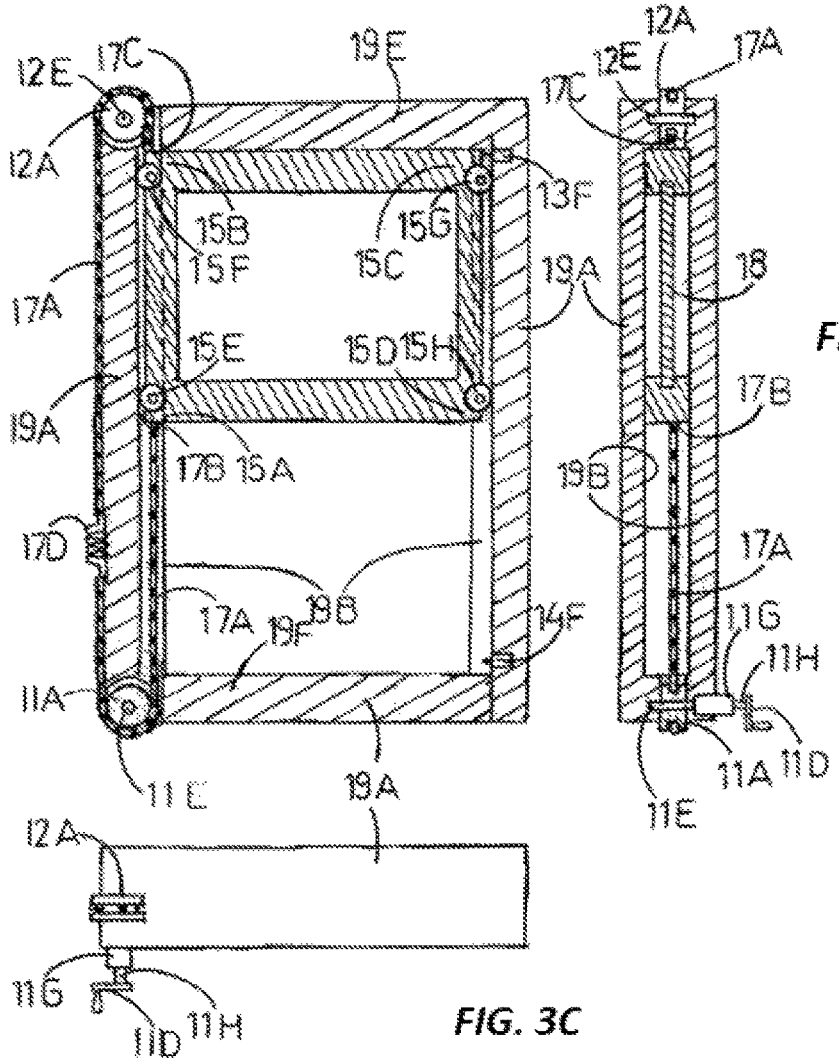
FIGS. 3A, 3B, 3C show the frontal, side and top views respectively of the single roller chain mechanism sliding window mechanism.
Figures 6A, 6B, 6C:
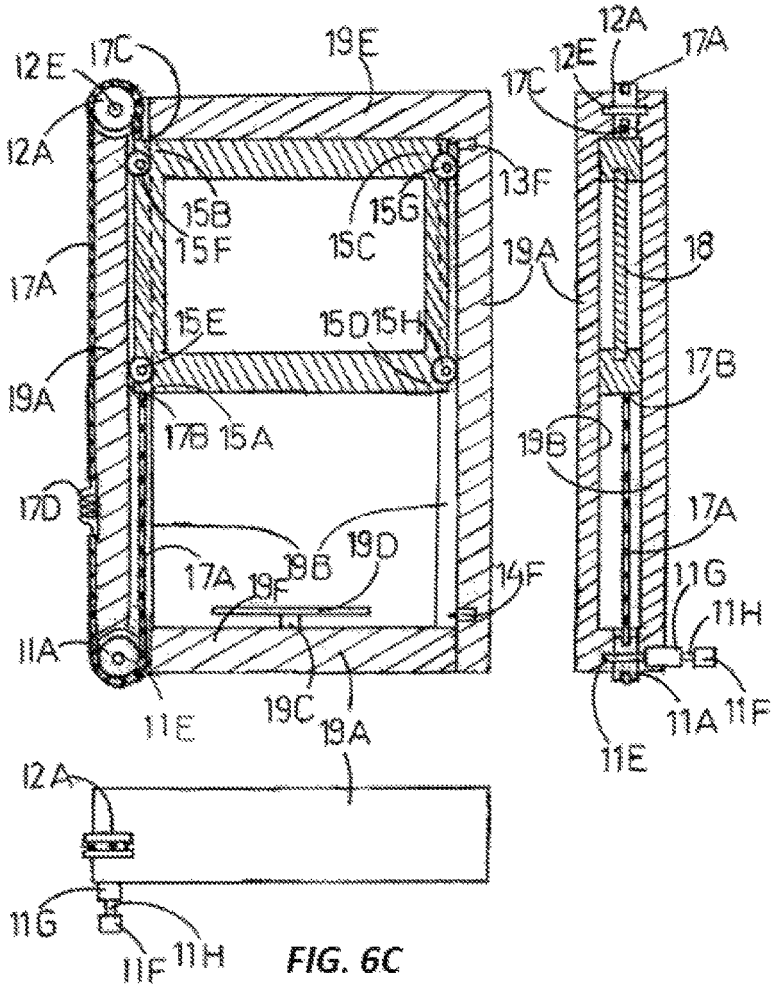
FIGS. 6A, 6B, 6C are identical to FIGS. 3A, 3B, 3C except for the replacement of the crank with an electrical motor which enables motorized opening and closing.

FIGS. 3A, 3B, 3C describe three views of the single roller chain sliding window mechanism. FIGS. 6A, 6B, 6C are identical to FIGS. 3A, 3B, 3C except for the replacement of the crank 11D with the electrical motor 11F and the addition of the safety system 19C (safety switch) and 19D (safety bar). The single roller chain sliding window mechanism includes the two single track sprockets: 11A and 12A the roller chain: 17A and the sliding frame with 4 corners: 15A-15B-15C-150. The lower left sprocket 11A is installed at the lower left outer corner of the outer frame 19A. The upper left sprocket 12A is installed at the upper left outer corner of the outer frame 19A. The rolling chain 17A has an upper end and a lower end. Where the lower end is attached to the lower left corner 15A and the upper end of the rolling chain is attached to the upper left 15B corner of the sliding frame. The rolling chain is strung downwards starting from the lower left 15A corner and is wound around the lower left sprocket 11A. Next, the rolling chain 17A is strung upwards and is wound around the upper left sprocket 12A. Next the rolling chain 17A is strung downwards and ends at the upper left 15B corner.

The lower left sprocket 11A also has a crank 110 for manual operation. The crank 110 is installed on the input gearbox axis 11H of the gearbox 11G which is connected by the output axis 11E to the lower left sprocket 11A. When the sprocket 11A is turned incrementally in clockwise direction, the left side of the rolling chain section 17A is moved upwards by a distance increment: dz. As a result the lower end of the rolling chain 17A moves downwards by dz and pull downwards also by dz the sliding frame lower left corner 15A. At the same time, the corresponding upper cable section 17A also moves downwards by dz and allows its attached sliding frame upper left corner 15B to move downwards by the same distance increment dz. As a consequence, the whole sliding frame is moved downwards by dz. Thus, by turning the sprocket 11A in clockwise direction the sliding frame can be moved downwards as much as needed within the range allowed by the outer frame. As illustrated in FIG. 6, the crank 110 is replaced by an electrical motor 11F to provide motorized opening and closing of the two cable sliding window mechanism.

On the other hand, when the sprocket 11A is turned incrementally in counterclockwise direction, the left side of the cable 17A is moved downwards by the distance increment: dw. As a result the lower end of the rolling chain 17C moves upwards by dw and allows the sliding frame lower left corner 15A to move upwards by dw. At the same time, the upper end 17G of the rolling chain 17A also moves upwards by dw and pull upwards its attached sliding frame upper left corner 15B by the same distance increment dw. As a consequence, the whole sliding frame is moved upwards by dw. Thus, by turning the sprocket 11A in counterclockwise direction the whole sliding frame can be moved upwards as much as needed within the range allowed by the outer frame.

FIGS. 3A, 3B, 3C show three views of the sliding window single rolling chain mechanism. As can be observed in FIG. 3A, the pane 18 is framed by the sliding frame which has four corners: 15A, 15B, 15C, 15D. The sliding frame is guided by two parallel, vertical guides 19B which are at the inner side of the vertical bars of the outer frame 19A. The rollers 5E, 5F, 5G, 5H are installed at recesses near the corresponding sliding frame corners: 5A, 5B, 5C, 5D. The single track sprockets: lower left sprocket 11A and upper left sprocket 12A are installed at the lower left corner and the upper left corner of the outer frame 19A respectively. Rolling chain 17A is also wound around sprockets: 12A, The lower left sprocket 11A also has a crank 11D for manual operation. The crank 110 is installed on the input gearbox axis 11H of the gearbox 11G which is connected by the output axis 11E to the lower left sprocket 11A. The left spring 17D is preloaded and keeps the tension level of the rolling chain 17A.

FIG. 4 describes in isometric drawing the moving parts of the two cables mechanism. This includes the four pulleys: 1A, 2A, 3A and 4A, the left cable: 6A-6B-6C and the right cable 7A-7B-7C and the sliding frame four corners: 5A-5B-5C-5D. Pulley 1A is the lower two track pulley installed at the lower left outer corner of the outer frame. Pulley 2A is the upper two track pulley installed at the upper left outer corner of the outer frame. Pulley 4A is the lower single track pulley installed at the lower right outer corner of the outer frame. Pulley 3A is the upper two track pulley installed at the upper right outer corner of the outer frame. The left cable has an upper left end 6C and a lower left end 6B. Where the lower left end is attached to the lower left corner 5A of the sliding frame. The upper left end 6C is attached to the upper left corner 5B. The left cable 6A is strung downwards starting from the lower left corner 5A and is wound around the first lower track 1B of the lower two track pulley 1A. Next the left cable is strung upwards and is wound around the first upper track 2B of the upper two track pulley 2A. Next, the left cable is strung downwards and ends at the upper left end 6C, which is attached to the upper left corner 5B.

The right cable comprising an upper right end 7C and a lower right end 7B. Where the lower right end 7B is attached to the lower right corner 5D. The upper right end 7C is attached to the upper right corner 5C.

The right cable 7A is strung downwards starting from the lower right end 7B and is wound around the lower single track pulley 4A. Next, the right cable 7A is strung leftwards and is wound around the second lower track 1C of the lower two track pulley 1A. Next, the right cable is strung upwards and is wound around the second upper track 2C of the upper two track pulley 2A. Next, the right cable 7A is strung rightwards and is wound around the upper single track pulley 3A. Next, the right cable is strung downwards and ends at upper right end 7C, which is attached to the upper right corner 5C of the sliding frame.

The lower two track pulley 1A also is connected to an electrical motor 1F. The electrical motor 1F is connected to the input gearbox axis 1H of the gearbox 1G which is connected by the output gearbox axis 1E to the lower two track pulley 1A. When the pulley 1A is turned incrementally in clockwise direction, the left hand side of the cables 6A (left cable) and 7A (right cable) is moved upwards by the same distance increment: dx. As a result the lower ends of the cables 6A and 7A which are denoted by 6B and 7B correspondingly (lower left end and lower right end) move downwards by dx and pull downwards also by dx the corresponding sliding frame corners 5A (denoted by: lower left corner) and 5D (denoted by: lower right corner). At the same time, the corresponding upper cable ends 6C and 7C also move downwards by dx and allow their correspondingly attached sliding frame corners 5B (upper left corner) and 5C (upper right corner) to move downwards by the same distance increment dx. As a consequence, the whole sliding frame is moved downwards by dx. Thus, by turning the lower two track pulley 1A in clockwise direction the sliding frame can be moved downwards as much as needed within the range of the outer frame.

On the other hand, when the lower two track pulley 1A is turned incrementally in counterclockwise direction, the left hand sides of the left and right cables 6A and 7A are moved downwards by the same distance increment: dy. As a result the lower ends of the left and right cables 6A and 7A which are denoted by 6B and 7B correspondingly, move upwards by dy and allow the corresponding sliding frame lower left and lower right corners 5A and 5D to move upwards by dy. At the same time, the corresponding upper left and right cable ends 6C and 7C also move upwards by dy and pull upwards their correspondingly attached sliding frame upper left and upper right corners 5B and 5C by the same distance increment dy. As a consequence, the sliding frame is moved upwards by dy. Thus, by turning the lower two track pulley 1A in counterclockwise direction the sliding frame can be moved upwards as much as needed within the range of the outer frame.

Additional features displayed in FIG. 4 are the two tracks of the lower two track pulley 1A i.e. the first lower track 1B and the second lower track 1C. Similarly the two tracks of the upper two track pulley 2A are the first upper track 2B and the second upper track 2C. The two cables mechanism is equipped also with an upper limit switch 3F and a lower limit switch 4F and with a lower spring 7D and an upper spring 7E for preserving the tension level of the right cable and the left spring 6D for preserving the tension level of the left cable. The upper limit switch 3F is activated when the sliding frame presses on its lever. Thus the upper limit switch 3F is configured to stop the electrical motor 1F when the sliding frame reaches its highest position. The lower limit switch 4F is activated when the sliding frame presses on its lever. Thus the lower limit switch 4F is configured to stop the electrical motor 1F when the sliding frame reaches its lowest position. The lower limit switch 4F could have another use, it can activate a burglar alarm when it is deactivated by a burglar opening the window.

Figure 7:
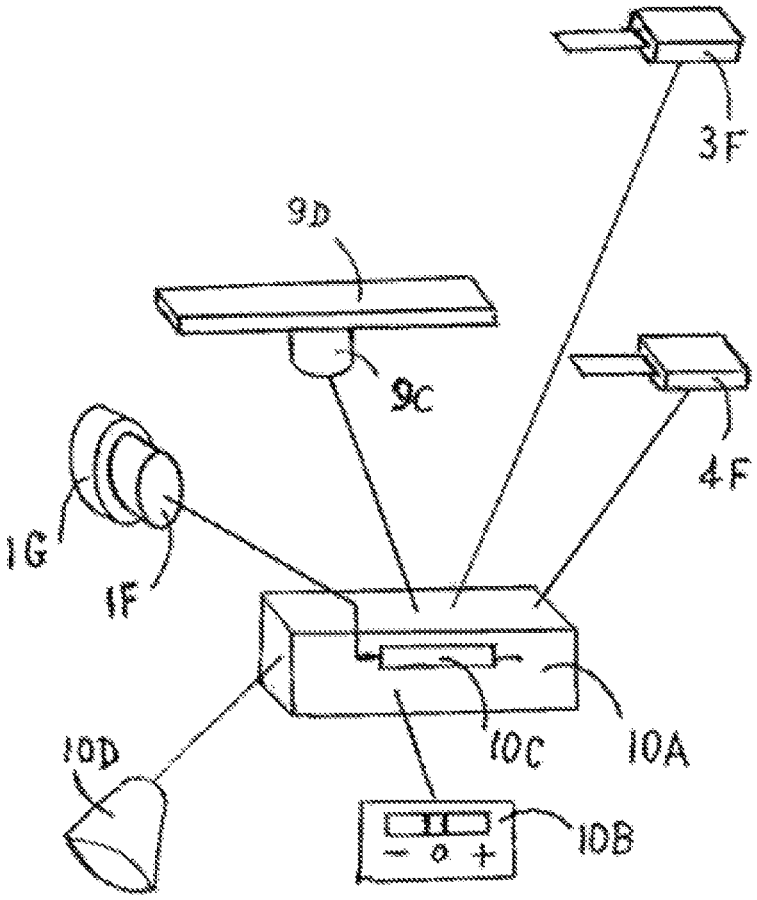
FIG. 7 describes the control unit which controls the electrical motor's direction and speed. The control unit is connected to limit and safety switches, to the electrical motor and to the burglar alarm.

FIG. 7 describes the control unit 10A, which is an electronic device which is connected to the limit switches 3F and 4F the electrical motor 1F, the safety switch 9C, the overload sensor 10C, the control box 10B and the burglar alarm 10D. The control unit 10A controls the speed and direction of the electrical motor 1F. The user can control the electrical motor 1F using a control box 10B which also is connected to the control unit 10A.

The sliding window two cables mechanism and the two rolling chain mechanism have an additional safety system which is designed to prevent accidents where the window closes on a person leaning out the window. The safety system includes a safety switch 9C and a safety bar 9D. Where the safety switch is connected to a control unit 10A. The safety switch 9C is installed on top of the lower horizontal bar 9F of the outer frame 9A. The safety bar 9D is installed on top of the safety switch 9C. A person leaning out the window while the window is closing, will be pressing down the safety bar 9D which activates the safety switch 9C which instructs the control unit 10A to reverse the direction the electrical motor 1F. Whereby, the sliding window reverses direction from closing to opening.

Another proposed safety feature is to add to the control unit 10A an overload sensor 10C. The control unit 10A is configured to reverse the direction of the electrical motor 1F when the overload sensor 10C senses a sudden overload of the electrical motor 1F due to an object that blocks the sliding window's motion.

Figure 8:
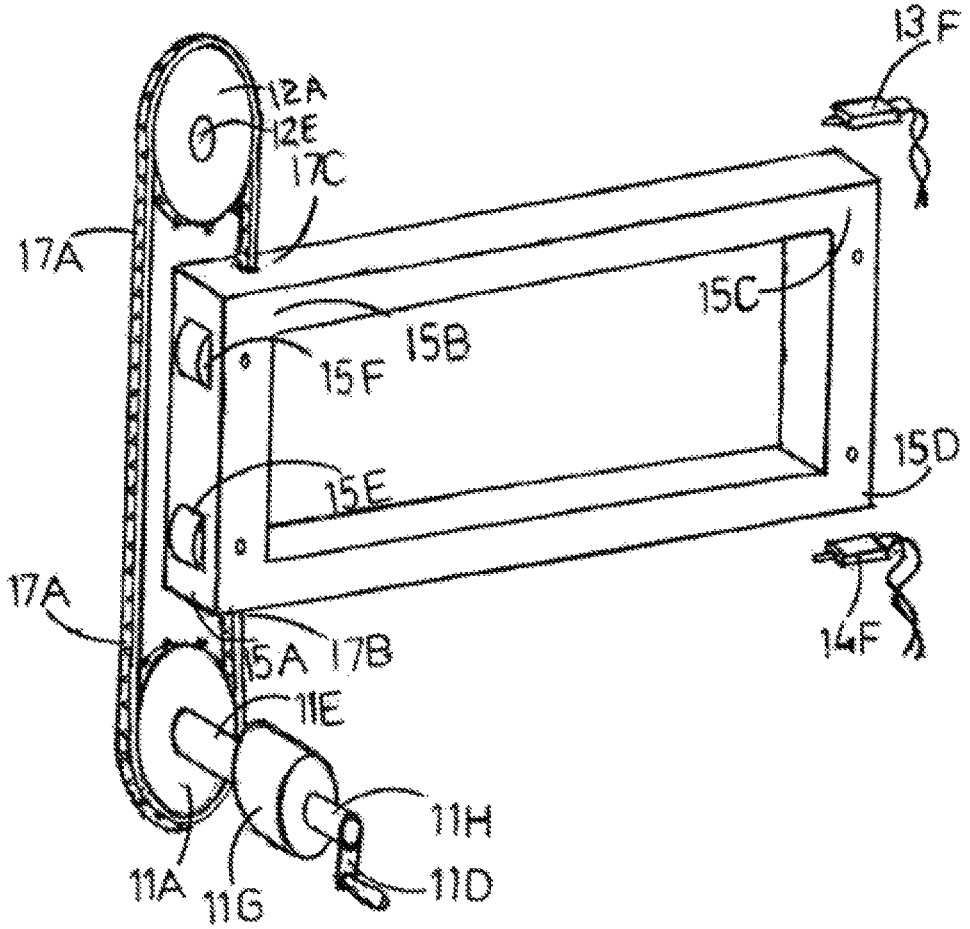
FIG. 8 illustrates the single roller chain mechanism with manual operation in a blow-up isometric drawing.
Figure 9:
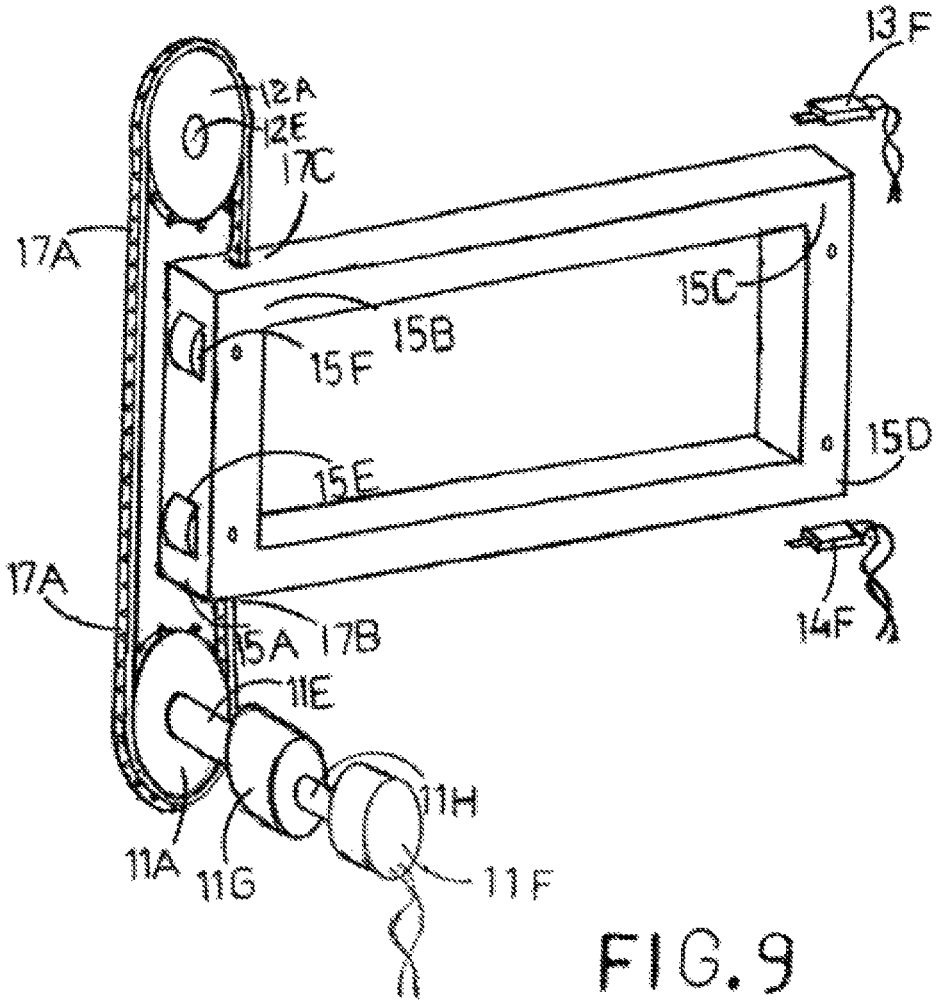
FIG. 9 describes in a blow-up isometric drawing the moving parts of the single roller chain mechanism with motorized operation.

FIG. 8 describes a blow up isometric view of the single roller chain sliding window mechanism. FIG. 9 is identical to FIG. 8 except for the replacement of the crank 110 with the electrical motor 11F and the addition of the safety system 19C (safety switch) and 19D (safety bar). The single roller chain sliding window mechanism includes the two single track sprockets: 11A, 12A the roller chain: 17A and the sliding frame with 4 corners: 15A-15B-15C-15D. The lower left sprocket 11A is installed at the lower left outer corner of the outer frame 19A. The upper left sprocket 12A is installed at the upper left outer corner of the outer frame 19A. The rolling chain 17A has an upper end and a lower end. Where the lower end is attached to the lower left corner 15A and the upper end of the rolling chain is attached to the upper left 15B corner of the sliding frame. The rolling chain is strung downwards starting from the lower left 15A corner and is wound around the lower left sprocket 11A. Next, the rolling chain 17A is strung upwards and is wound around the upper left sprocket 12A. Next the rolling chain 17A is strung downwards and ends at the upper left 15B corner.

The lower left sprocket 11A also has a crank 110 for manual operation. The crank 110 is installed on the input gearbox axis 11H of the gearbox 11G which is connected by the output axis 11E to the lower left sprocket 11A. FIGS. 8 and 9 also show the limit switches 14F, 13F which are connected to the control unit.

The rollers 15E, 15F are also shown to protrude from their recesses in the sliding frame. In FIG. 9 the electrical motor 11F is installed on the input gearbox axis 11H of the gearbox 11G which is connected by the output axis 11E to the lower left sprocket 11A. In addition, it has also the safety system 19C (safety switch) and 19D (safety bar). Pressing on the safety bar activates the safety switch 19C, which is connected to the control unit 10A. Then the control unit reverses the motor 11F which raises the window.

Figure 10:
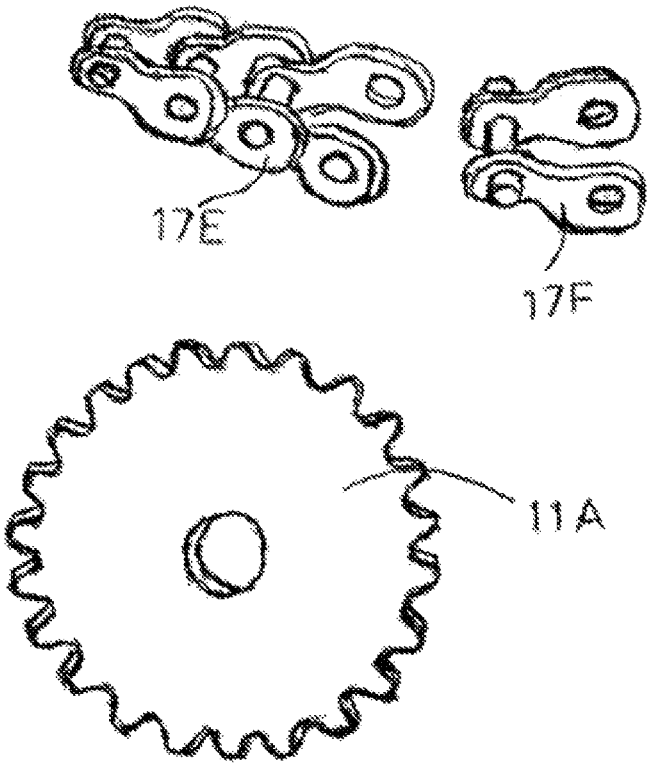
FIG. 10 depicts the structure and components of the roller chain and the sprocket wheel.

FIG. 10 depicts the structure and components of the roller chain 17E, 17F and the sprocket wheel 11A.

Figure 11:
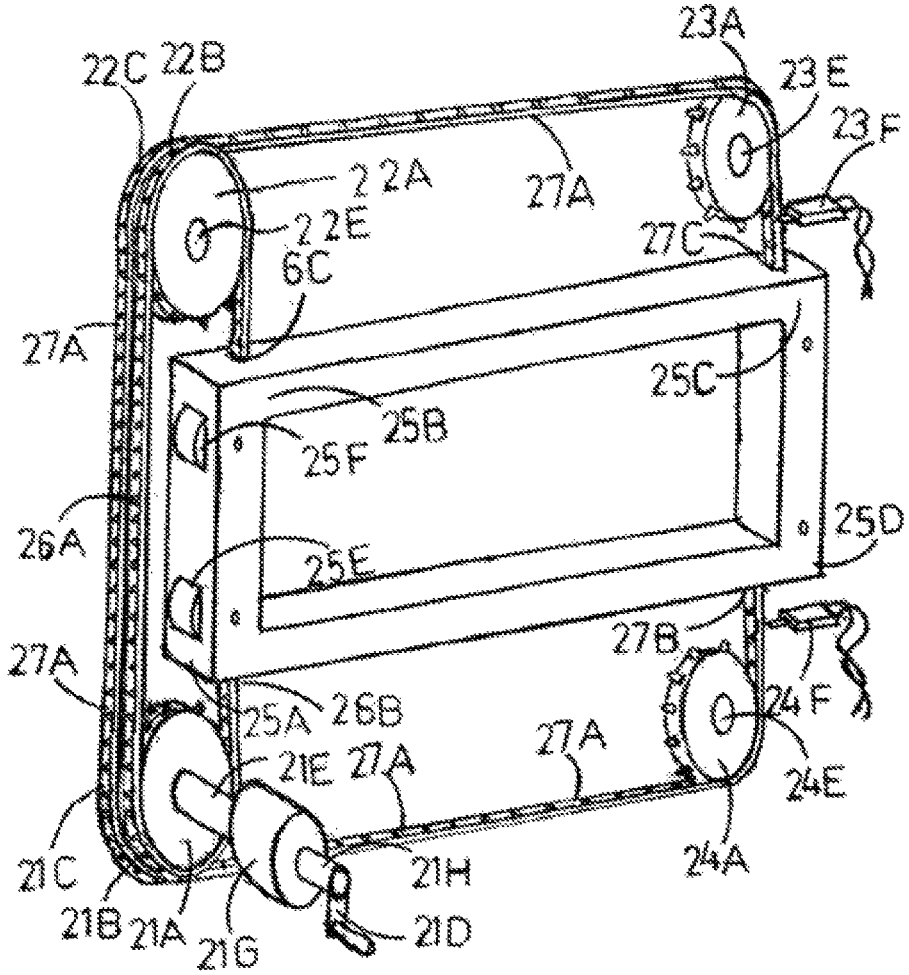
FIG. 11 describes in a blow-up isometric drawing the moving parts of the two chains mechanism with manual operation.
Figure 12:
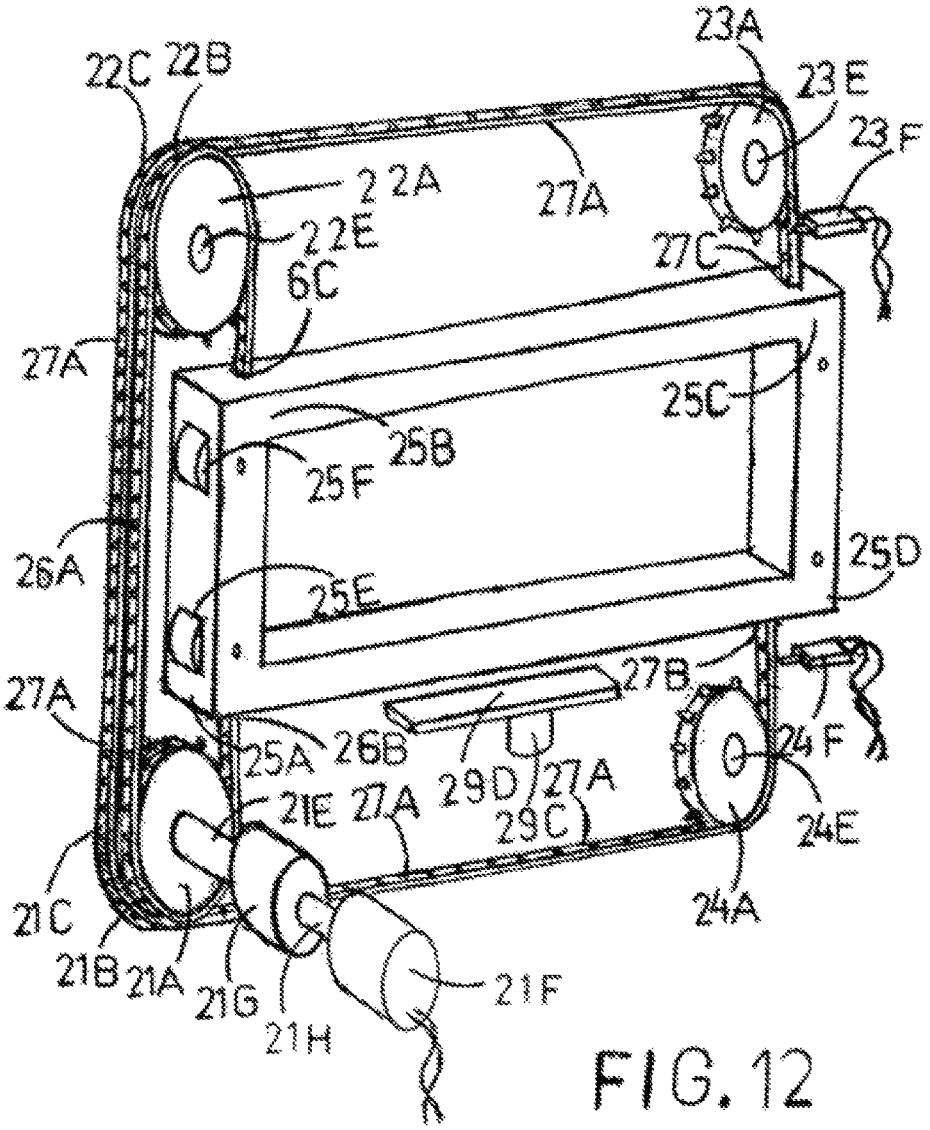
FIG. 12 describes in a blow-up isometric drawing the moving parts of the two chains mechanism with motorized operation.

FIG. 11 describes in a blow-up isometric drawing the moving parts of the two chains mechanism with manual operation. FIG. 12 is identical to FIG. 11 except for the replacement of the crank 21D with the electrical motor 21F. In FIG. 12 the electrical motor 21F is installed on the input gearbox axis 21H of the gearbox 21G which is connected by the output axis 21E to the lower left sprocket 21A. The motor 21F is connected to the control unit which controls its speed and direction. In addition, it has also the safety system 29C (safety switch) and 29D (safety bar). Pressing on the safety bar activates the safety switch 29C, which is connected to the control unit 10A. Then the control unit reverses the motor 21F which raises the window.

As can be observed in FIG. 11, the sliding frame has four corners: 25A, 25B, 25C, 25D. The rollers 25E, 25F, 25G, 25H are installed at recesses near the corresponding sliding frame corners: 25A, 25B, 25C, 25D. The two track sprockets 21A and 22A are installed at the lower left corner and the upper left corner of the outer frame 29A. The single track sprockets 24A and 23A are installed at the lower right corner and the upper right corner of the outer frame 29A. As seen in FIG. 11, the left and right roller chains 26A and 27A are wound around the corresponding first lower track 21B and in second lower track 21C of the lower two track sprocket 21A. Next, roller chains 26A and 27A are strung upwards and wound around the corresponding first upper track 22B and second upper track 22C of upper two track sprocket 22A. The single track sprockets: upper single track sprocket 23A and lower single track sprocket 24A are installed at the corresponding upper right and the lower right corners of the outer frame 29A.

FIG. 11 describes in isometric drawing the moving parts of the two chains mechanism. This includes the four sprockets: 21A, 22A, 23A and 24A, the left roller chain: 26A-26B-26C and the right roller chain 27A-27B-27C and the sliding frame four corners: 25A-25B-25C-25D. Sprocket 21A is the lower two track sprocket installed at the lower left outer corner of the outer frame. Sprocket 22A is the upper two track sprocket installed at the upper left outer corner of the outer frame. Sprocket 24A is the lower single track sprocket installed at the lower right outer corner of the outer frame. Sprocket 23A is the upper single track sprocket installed at the upper right outer corner of the outer frame. The left roller chain has an upper left end 26C and a lower left end 26B. Where the lower left end 26B is attached to the lower left corner 25A of the sliding frame. The upper left end 26C is attached to the upper left corner 25B. The left roller chain 26A is strung downwards starting from the lower left corner 25A and is wound around the first lower track 21B of the lower two track sprocket 21A. Next the left roller chain is strung upwards and is wound around the first upper track 22B of the upper two track sprocket 22A. Next, the left roller chain is strung downwards and ends at the upper left end 26C, which is attached to the upper left corner 25B.

The right roller chain comprising an upper right end 27C and a lower right end 27B. Where the lower right end 27B is attached to the lower right corner 25D. The upper right end 27C is attached to the upper right corner 25C.

The right roller chain 27A is strung downwards starting from the lower right end 27B and is wound around the lower single track sprocket 24A. Next, the right roller chain 27A is strung leftwards and is wound around the second lower track 21C of the lower two track sprocket 21A. Next, the right roller chain is strung upwards and is wound around the second upper track 22C of the upper two track sprocket 22A. Next, the right roller chain 27A is strung rightwards and is wound around the upper single track sprocket 23A. Next, the right roller chain is strung downwards and ends at upper right end 27C, which is attached to the upper right corner 25C of the sliding frame.

The lower two track sprocket 21A also has a crank 21D for manual operation. The crank 21D is installed on the input gearbox axis 21H of the gearbox 21G which is connected by the output gearbox axis 21E to the lower two track sprocket 21A.

Sprocket 21A has a crank 21D which is installed on the input gearbox axis 21H. The gearbox has an output gearbox axis 21E which is connected to the axis 21E and enables manual turning of the lower two track sprocket 21A which drives the whole sliding window mechanism. As illustrated in FIG. 12 the crank 21D is replaced by an electrical motor 21F to provide motorized opening and closing of the two roller chain sliding window mechanism. The limit switches which limit the travel of the sliding frame within the outer frame are also shown: 23F and 24.

What is claimed is:

1. A two cables mechanism configured for opening and closing a sliding window comprising: an outer frame, a sliding window, a lower two track pulley, an upper two track pulley, a lower single track pulley, an upper single track pulley, a left cable made of elastic material, a right cable made of elastic material and a crank;

said sliding window comprising: a sliding frame and a pane; wherein said pane is made of transparent material; wherein said pane is framed in said sliding frame;

wherein said sliding frame comprising: a lower left corner, an upper left corner, a lower right corner and an upper right corner;

said outer frame comprises two vertical parallel guides, a lower outer horizontal bar and an upper outer horizontal bar; wherein said vertical parallel guides are configured to guide said sliding frame in sliding up and down within said outer frame;

said outer frame comprising a lower left outer corner, an upper left outer corner, a lower right outer corner and an upper right outer corner;

said lower two track pulley is installed at said lower left outer corner; said upper two track pulley is installed at said upper left outer corner; said lower single track pulley is installed at said lower right outer corner; said upper single track pulley is installed at said upper right outer corner;

wherein said lower two track pulley comprising: a first lower track and a second lower track; wherein said upper two track pulley comprising: a first upper track and a second upper track;

said left cable comprising an upper left end and a lower left end; wherein said lower left end is attached to said lower left corner; wherein said upper left end is attached to said upper left corner; wherein said left cable is strung downwards starting from said lower left end and is wound around said first lower track; next, said left cable is strung upwards and is wound around said first upper track; next, said left cable is strung downwards and ends at said upper left end, which is attached to said upper left corner;

said right cable comprising an upper right end and a lower right end; wherein said lower right end is attached to said lower right corner; said upper right end is attached to said upper right corner;

wherein said right cable is strung downwards starting from said lower right end and is wound around said lower single track pulley; next, said right cable is strung leftwards and is wound around said second lower track; next, said right cable is strung upwards and is wound around said second upper track; next, said right cable is strung rightwards and is wound around said upper single track pulley; next, said right cable is strung downwards and ends at upper right end, which is attached to said upper right corner;

said crank is mechanically connected to said lower two track pulley and is configured to facilitate manual turning of said lower two track pulley;

wherein, turning in clockwise direction said lower two track pulley facilitates said left cable pulling down said lower left corner while releasing said upper left corner;

wherein, turning in clockwise direction said lower two track pulley facilitates said right cable pulling down said lower right corner while releasing said upper right corner;

wherein, turning in counterclockwise direction said lower two track pulley facilitates said left cable pulling up said upper left corner while releasing said lower left corner;

wherein, turning in counterclockwise direction said lower two track pulley facilitates said right cable pulling up said upper right corner while releasing said lower right corner;

wherein, said two cables mechanism is configured to move downwards said sliding window by turning said crank in clockwise direction and said two cables mechanism is configured to move upwards said sliding window by turning said crank in counterclockwise direction.

2. The two cables mechanism of claim 1, comprising a gearbox, which is connected to an input gearbox axis and an output gearbox axis; wherein said crank is connected to said input gearbox axis; wherein said output gearbox axis is connected to said lower two track pulley; wherein said crank is configured to manually turn said input gearbox axis; wherein output gearbox axis is configured to turn said lower two track pulley; wherein said gearbox is configured to convert a turning speed of said input gearbox axis into a lower turning speed of said output gearbox axis by a predetermined ratio.

3. The two cables mechanism of claim 2, comprising: an electrical motor and a control unit; wherein said crank is replaced by the electrical motor, which is mechanically connected to said input gearbox axis; wherein said electrical motor is electrically connected to said control unit; wherein said control unit controls a direction of said electrical motor and a speed of said electrical motor; wherein said control unit is electrically connected to a control box by which a user can control the direction of said electrical motor and the speed of said electrical motor;

wherein, said electrical motor is configured to move said sliding window up or down by turning said lower two track pulley in clockwise direction or in counterclockwise direction respectively.

4. The two cables mechanism of claim 3, comprising: a lower limit switch and an upper limit switch; wherein said lower limit switch is configured to be activated when said sliding frame reaches a lowest position within said outer frame; wherein said upper limit switch is configured to be activated when said sliding frame reaches a highest position within said outer frame; wherein said lower limit switch and said upper limit switch are electrically connected to said control unit; wherein said control unit is configured to stop said electrical motor when said lower limit switch or said upper limit switch is activated.

5. The two cables mechanism of claim 4, further comprising: a burglar alarm electrically connected to said control unit; wherein said lower limit switch is configured to activate said burglar alarm when said lower limit switch is deactivated and said burglar alarm is armed.

6. The two cables mechanism of claim 3, comprising: a safety switch and a safety bar; wherein safety switch is electrically connected to said control unit; wherein said safety switch is installed on top of said lower outer horizontal bar; wherein said safety bar is installed on top of said safety switch;

wherein, said safety bar is configured to activate said safety switch when pressured; wherein, said control unit is configured to control the direction of said electrical motor when said safety switch is activated;

whereby, said sliding window is moved upwards when said safety bar is pressurized.

7. The two cables mechanism of claim 3, further comprising: an overload sensor electrically connected to said control unit; wherein said control unit is configured to reverse the direction of said electrical motor when said overload sensor senses a sudden overload of said electrical motor due to a blocking of said sliding window's motion.

8. The two cables mechanism of claim 1, wherein said left cable is wound around said first lower track at least once; wherein said right cable is wound around said second lower track at least once.

9. The two cables mechanism of claim 1, comprising: an upper spring with an upper spring bias, a lower spring with a lower spring bias and a left spring with a left spring bias; wherein said upper spring is connecting two segments of said right cable strung between said second upper track and said upper single track pulley; wherein said lower spring is connecting two segments of said right cable strung between said second lower track and said lower single track pulley; wherein said left spring is connecting two segments of said left cable strung between said first lower track and said first upper track;

wherein said left spring bias preserves a predetermined tension level of said left cable; wherein said upper spring's bias and said lower spring's bias preserve a predetermined tension level of said right cable.

10. The two cables mechanism of claim 1, further comprising a lower left roller, an upper left roller, a lower right roller and an upper right roller; wherein said lower left roller is installed at said lower left corner, said upper left roller is installed at said upper left corner, said lower right roller is installed at said lower right corner and said upper right roller is installed at said upper right corner; wherein said lower left roller, said upper left roller, said lower right roller and said upper right roller facilitate sliding up and down of said sliding frame within said outer frame.

11. A two chains mechanism for opening and closing a sliding window comprising: an outer frame, a sliding window, a lower two track sprocket, an upper two track sprocket, a lower single track sprocket, an upper single track sprocket, a left roller chain, a right roller chain and a crank; said sliding window comprising: a sliding frame and a pane; wherein said pane is made of transparent material; wherein said pane is framed in said sliding frame;

wherein said sliding frame comprising: a lower left corner, an upper left corner, a lower right corner and an upper right corner; said outer frame comprises two vertical parallel guides, a lower outer horizontal bar and an upper outer horizontal bar; wherein said vertical parallel guides are configured to guide said sliding frame in sliding up and down within said outer frame;

said outer frame comprising a lower left outer corner, an upper left outer corner, a lower right outer corner and an upper right outer corner;

said lower two track sprocket is installed at said lower left outer corner; said upper two track sprocket is installed at said upper left outer corner; said lower single track sprocket is installed at said lower right outer corner; said upper single track sprocket is installed at said upper right outer corner;

wherein said lower two track sprocket comprising: a first lower track and a second lower track; wherein said upper two track sprocket comprising: a first upper track and a second upper track;

said left roller chain comprising an upper left end and a lower left end; wherein said lower left end is attached to said lower left corner; wherein said upper left end is attached to said upper left corner; wherein said left roller chain is strung downwards starting from said lower left end and is wound around said first lower track; next, said left roller chain is strung upwards and is wound around said first upper track; next, said left roller chain is strung downwards and ends at said upper left end, which is attached to said upper left corner;

said right roller chain comprising an upper right end and a lower right end; wherein said lower right end is attached to said lower right corner; said upper right end is attached to said upper right corner;

wherein said right roller chain is strung downwards starting from said lower right end and is wound around said lower single track sprocket; next, said right roller chain is strung leftwards and is wound around said second lower track; next, said right roller chain is strung upwards and is wound around said second upper track; next, said right roller chain is strung rightwards and is wound around said upper single track sprocket; next, said right roller chain is strung downwards and ends at upper right end, which is attached to said upper right corner;

said crank is mechanically connected to said lower two track sprocket and is configured to facilitate manual turning of said lower two track sprocket;

wherein, turning in clockwise direction said lower two track sprocket facilitates said left roller chain pulling down said lower left corner while releasing said upper left corner;

wherein, turning in clockwise direction said lower two track sprocket facilitates said right roller chain pulling down said lower right corner while releasing said upper right corner;

wherein, turning in counterclockwise direction said lower two track sprocket facilitates said left roller chain pulling up said upper left corner while releasing said lower left corner;

wherein, turning in counterclockwise direction said lower two track sprocket facilitates said right roller chain pulling up said upper right corner while releasing said lower right corner;

wherein, said two chains mechanism is configured to move said sliding window downwards by turning said crank in clockwise direction and said two chains mechanism is configured to move said sliding window upwards by turning said crank in counterclockwise direction.

12. The two chains mechanism of claim 11, comprising a gearbox which is connected to an input gearbox axis and to an output gearbox axis; wherein said crank is connected to said input gearbox axis; wherein said output gearbox axis is connected to said lower two track sprocket; wherein said crank is configured to manually turn said input gearbox axis; wherein said output gearbox axis is configured to turn said lower two track sprocket; wherein said gearbox is configured to convert a turning speed of said input gearbox axis into a lower turning speed of said output gearbox axis by a predetermined ratio.

13. The two chains mechanism of claim 12, comprising: an electrical motor and a control unit; wherein said crank is replaced by the electrical motor, which is mechanically connected to said input gearbox axis; wherein said electrical motor is electrically connected to said control unit; wherein said control unit controls a direction of said electrical motor and a speed of said electrical motor; wherein said control unit is electrically connected to a control box by which a user can control the direction of said electrical motor and the speed of said electrical motor;

wherein, said electrical motor is configured to move said sliding window up or down by turning said lower two track sprocket in clockwise direction or in counterclockwise direction respectively.

14. The two chains mechanism of claim 13, comprising: a lower limit switch and an upper limit switch; wherein said lower limit switch is configured to be activated when said sliding frame reaches a lowest position within said outer frame; wherein said upper limit switch is configured to be activated when said sliding frame reaches a highest position within said outer frame; wherein said lower limit switch and said upper limit switch are electrically connected to said control unit; said control unit is configured to stop said electrical motor when either said lower limit switch or said upper limit switch is activated.

15. The two chains mechanism of claim 14, further comprising: a burglar alarm electrically connected to said control unit;

wherein said lower limit switch is configured to activate said burglar alarm when said lower limit switch is deactivated and said burglar alarm is armed.

16. The two chains mechanism of claim 13, comprising: a safety switch and a safety bar; wherein safety switch is electrically connected to said control unit; wherein said safety switch is installed on top of said lower outer horizontal bar; wherein said safety bar is installed on top of said safety switch;

wherein, said safety bar is configured to activate said safety switch when pressured; wherein said control unit is configured to control the direction of said electrical motor when said safety switch is activated;

wherein, said sliding window is moved upwards when said safety switch is pressurized.

17. The two chains mechanism of claim 13, further comprising: an overload sensor electrically connected to said control unit; wherein said control unit is configured to reverse the direction of said electrical motor when said overload sensor senses a sudden overload of said electrical motor due to a blocking of said sliding window.

18. The two chains mechanism of claim 11, further comprising: a lower left roller, an upper left roller, a lower right roller and an upper right roller; wherein said lower left roller is installed at said lower left corner, said upper left roller is installed at said upper left corner, said lower right roller is installed at said lower right corner and said upper right roller is installed at said upper right corner; wherein said lower left roller, said upper left roller, said lower right roller and said upper right roller facilitate sliding up and down of said sliding frame within said outer frame.

* * * * *